United States Patent [19]

Bitsch

[11] Patent Number: 5,036,999

[45] Date of Patent: Aug. 6, 1991

[54] WASTE-COLLECTING CONTAINER WITH A VENTILATING DEVICE

[76] Inventor: Bartholomaeus Bitsch, Eckweg 15, D-6145 Lindenfels 2, Fed. Rep. of Germany

[21] Appl. No.: 533,738

[22] Filed: Jun. 4, 1990

[30] Foreign Application Priority Data

Jun. 5, 1989 [DE] Fed. Rep. of Germany ..... 3918304
Nov. 29, 1989 [DE] Fed. Rep. of Germany ..... 3939511

[51] Int. Cl.[5] ..... B65D 81/24

[52] U.S. Cl. ..... 220/627; 220/367; 220/908

[58] Field of Search ..... 98/1; 220/627, 661, 220/673, 676, 908, 913, 367, DIG. 6, DIG. 27

[56] References Cited

U.S. PATENT DOCUMENTS 545,662 9/1895 Stewart ..... 220/908
2,659,362 11/1953 Strehl ..... 220/627 X
3,074,583 1/1963 Martinich, Jr. ..... 220/908 X
4,294,379 10/1981 Bard ..... 220/908 X
4,650,086 3/1987 Morrison, Jr. ..... 220/627 X

FOREIGN PATENT DOCUMENTS 566741 8/1960 Belgium ..... 220/908

*Primary Examiner*—Harold Joyce
*Attorney, Agent, or Firm*—Flynn, Thiel, Boutell & Tanis

[57] ABSTRACT

A waste-collecting container comprising an upper lid 1 and a lower part 2 which can be closed off by means of the lid. In order to be able to store and collect compostable wastes in the collecting container, the invention provides that an insert floor 4 is arranged in the lower part 2 spaced from the bottom wall 3 of the lower part, and that on at least one inside wall of the lower part 2 there is provided a shaftlike ventilating element 5 so that suitable decomposing operations can be aided by a circulation of air.

25 Claims, 2 Drawing Sheets

WASTE-COLLECTING CONTAINER WITH A VENTILATING DEVICE

FIELD OF THE INVENTION

The invention relates to a waste-collecting container comprising an upper lid and a lower part, which can be closed off by means of the lid.

BACKGROUND OF THE INVENTION

For reasons of environmental protection, the carefully directed collection and further processing of wastes is absolutely necessary in order, on the one hand, to minimize the amount of waste being created and, on the other hand, to facilitate a removal which protects the environment. Thus, demands made on the suitable collecting containers have also increased. The collecting containers must thereby be in particular adapted to the type of waste and must be adjusted to the waste.

In former times, waste removal was done such that the waste or garbage was collected in very simple containers (garbage cans) and was transported unsorted. In the meantime, special designs for waste-collecting containers have been developed, which in particular are adapted to the respective waste-removal vehicles in order to enable at least a partially automatic emptying of the containers. At this point the different container shapes are being pointed out. Furthermore, special collecting containers were developed for some raw material types, for example to collect old paper, old glass, and others.

In the course of the desires to minimize the volume of waste, tests have been conducted which revealed that among others, the average household waste includes well over 40% of compostable material which, among others, in view of the limited capacities of dumping sites, however, also for environmental protection and recycling reasons, should rather be subjected to a composting process in order to allow these waste materials to decompose in a natural cycle. The conventional collecting containers are not suited for collecting compostable wastes since the waste materials become too moist, rot and/or decompose in some other manner in the known containers so that, on the one hand, a composting cannot take place and that, on the other hand, bothersome effects, in particular odors occur.

The collecting of compostable wastes in common composting containers used in gardens or on farms is not possible for waste removal since often there is no space available for such containers and since these containers cannot be emptied using common waste-removal vehicles.

SUMMARY OF THE INVENTION

The purpose of the invention is to provide a waste-collecting container of the above-mentioned type which with a simple design and safe operation is suited for the collection and composting of compostable wastes and which can be emptied at least partially automatically into waste-removal vehicles.

The purpose is attained according to the invention by arranging in the lower part of the container spaced from its bottom an insert floor and by providing a cuplike ventilating element on at least one inside wall of the lower part.

The collecting container of the invention is distinguished by a number of significant advantages. Since both the insert floor and also the ventilating element prevent the compostable wastes from resting directly against the walls of the container and since thus a circulation of air is possible, the compostable wastes can accumulate in the collecting container over a longer period of time. Decomposition occurs already during this time so that it is possible to empty the collecting container at greater time intervals. This is an important advantage since often the accumulating amounts of waste are not sufficiently large to justify, for economic reasons, a weekly emptying of the collecting containers. Thus, the container of the invention facilitates a storage of the compostable wastes over a longer period of time so that in particular during warm weather, annoyances due to odor do not occur and hygiene requirements are met.

Since the collecting container of the invention can be designed as desired regarding its outer appearance, it is possible to use standardized collecting containers which, regarding their outside dimensions, are constructed such that they can be emptied at least partially automatically by common waste-removal vehicles. Thus, it is for example possible to use collecting containers with suitable wheels. It is also possible to design the collecting containers in different sizes, for example, in a container form or in the form of smaller garbage receptacles.

An advantageous further development of the invention provides that the lid has ventilating devices. Thus, a sufficient ventilation of the inside is not only assured by the insert floor and the ventilating element but also with the help of the lid.

The ventilation technique provided according to the invention assures that a constant air supply or rather air discharge is possible, which prevents rotting from taking place too quickly, avoids odor nuisance and permits badly smelling waste waters to evaporate so that the collecting container can be stored also in common garbage-collecting rooms.

Furthermore, it is advantageous according to the invention when the ventilating element is provided with noselike projections projecting into the inside space of the lower part, which projections have first air openings at their lower sides. The noselike projections have the result that the air openings, when the collecting container is filled, extend into a portion of its inside space in order to also subject the central volume areas to a sufficient composting operation. Furthermore, the noselike projections guarantee that the emptying operation of the collecting container is not hindered, since the composted contents can slide along a side of the collecting container not having the ventilating element, and they come loose from the projections during tipping of the collecting reservoir.

In order to improve this loosening operation and the emptying of the collecting container, the invention provides that the upper side of the projection is inclined at a relatively small angle with respect to the vertical, while the underside has a relatively large angle of inclination.

To increase the ventilating effect, it is furthermore advantageous when the wall of the lower part provided with the ventilating element is equipped with second air openings extending to the outside and through which air openings further air can enter and also exit.

The first ventilating openings or air openings in the projections of the ventilating element are preferably constructed in the shape of several slots which are parallel to one another and which are designed such that they cannot be clogged up with waste during emptying. However, it is also possible to provide suitable ventilating bores.

In order to permanently prevent the air openings of the ventilating element from becoming clogged by waste, it can furthermore be particularly advantageous when cleaning elements are provided on the inside of the ventilating elements, by means of which the air openings can be freed of waste materials. In order to assure a relative movement between the cleaning elements and the air openings, it is possible to support the cleaning elements stationarily in the lower part, while the ventilating element is movable. Alternatively it is, however, also advantageous to arrange the ventilating element stationarily in the collecting container, while the cleaning elements are movable. While the relative movement can for example be caused manually, it is also possible to couple the relative movement with a movement of the lid of the collecting container in order to clean the respective air openings automatically from waste materials every time the lid is opened and closed.

Since the collecting container of the invention is also supposed to be usable outside, it is advantageous to prevent the penetration of water. An inside lid provided with recesses is for this purpose arranged preferably on the outside lid, which inside lid catches the water penetrating through the recesses or openings of the lid and discharges it so that it does not reach the inside of the container. The large air bores in the inside lid permit the air flow to easily penetrate through the inside lid. Condensates forming on the inner surface of the outside lid are discharged in this manner since they flow over the container edge to the outside. The inner surface of the outside lid has discharge ribs, which lie offset with respect to the convection bores of the inside lid and are arranged as drip noses between the air domes of the inside lid.

The insert floor is advantageously of a riblike design and has recesses in particular at the lower rib areas so that the water in the waste can drain unhindered into the space below the insert floor. To improve ventilation, a further development of the invention provides that the space formed by the insert floor is connected to the inside space of the ventilating element so that air circulation can be reinforced.

Since it is also desirable when emptying the collecting container to remove the water accumulated in the bottom area from the collecting container, it is advantageously provided that the space formed by the insert floor is provided with a liquid discharge opening ending in the lower part.

The lid is advantageously provided with means for catching and/or discharging of water, for example with a suitable rib structure or with a suitable arrangement of openings.

It is furthermore particularly advantageous according to the invention when the openings of the container extending to the outside are equipped with means to prevent insects or other animals from entering the container, for example, by a suitable diameter reduction of the openings or with additional screens or other like structures.

The collecting container of the invention thus represents a permanent solution regarding the collecting and the emptying of compostable waste and the badly smelling waste water created during the in between storage, which water can evaporate over time, however, is in every case separated from the waste so that bothersome smell does not occur.

The collecting container can be provided preferably with a rectangular or square cross section, however, it is also possible to use round container cross sections.

It is particularly advantageous according to the invention when the ribs of the insert floor are designed fanlike and are turned upwardly with narrow, conical profile sides and have relatively small spacer ribs with respect to the bottom of the container, with the ribs having water-permeable channels on their hollow side. Since the ribs of the insert floor are connected to the inside space of the ventilating element and are formed such that they rise toward the ventilating element, the natural convection of the air is favored.

It is furthermore possible according to the invention to provide several ventilating elements on a collecting container.

Alternatively to the recesses on the lid, it is also possible to construct suitable ventilations on its peripheral area, namely to profile the edge of the lid. The hinge of the lid can furthermore have a greater clearance in order to assure a uniform contact of the lid and to prevent undesired insects from entering.

BRIEF DESCRIPTION OF THE DRAWINGS

The invention will be described hereinafter with reference to exemplary embodiments shown in the drawings, in which.

DETAILED DESCRIPTION

Figure 1:
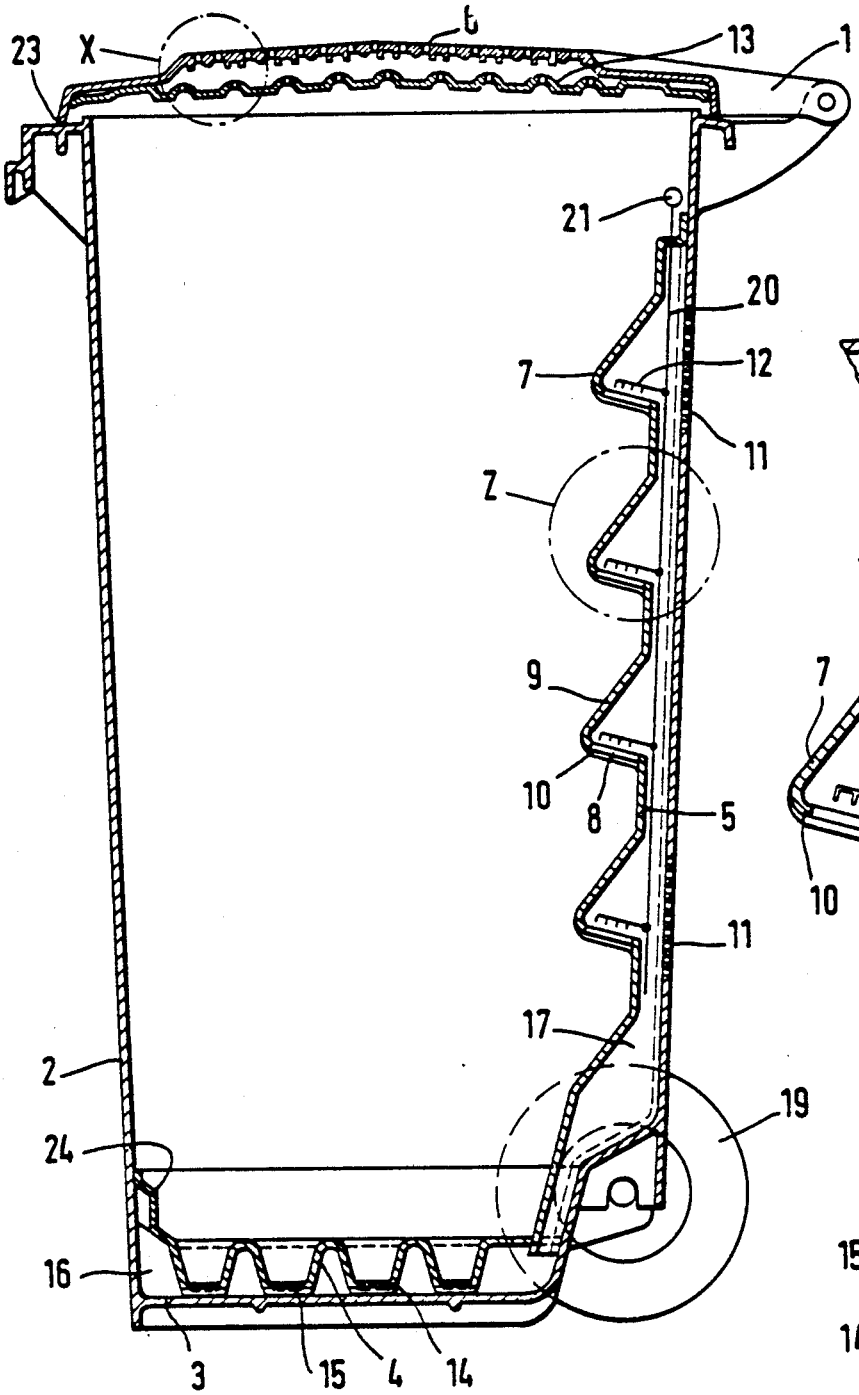
FIG. 1 is a schematic side view of a first exemplary embodiment of the collecting container.

The waste-collecting container of the invention includes a lid 1 and a lower part 2, which can be designed like a common garbage can. The lower part 2 has for example wheels 19 facilitating an easy movement and handles not shown in detail.

An insert floor 4 is placed onto the upper surface of the bottom 3 inside of the lower part 2, which insert floor 4 will be described in detail in particular in connection with FIGS. 2 to 4. The insert floor 4 defines a space 16 with the lower part 2, which space 16 passes over into an inside space 17 formed by a ventilating element 5 arranged on an inside wall of the container.

Figure 5:
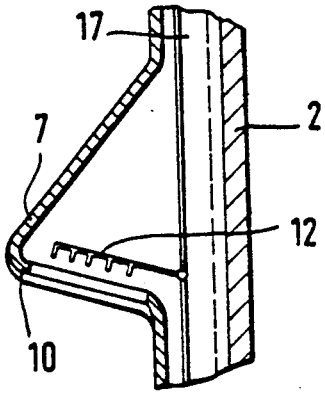
FIG. 5 is an enlarged illustration of the detail Z of FIG. 1.

The ventilating element 5 has several noselike projections 7, the upper side 9 of which is inclined at an acute angle with respect to the vertical which is less than the angle of the underside 10 to the vertical, which underside 10 is provided with first air openings 8. The openings 8 are designed substantially slotlike as shown in FIG. 5. The ventilating element is otherwise described in detail hereinafter in connection with FIGS. 9 to 12.

Several cleaning elements 12 are arranged in the inside space 17 of the ventilating element 5, which cleaning elements 12 are each for example designed comblike and are coupled together by a rod 20. The cleaning elements 12 are movable relative to the ventilating element 5, for example, by means of a handle 21 arranged on the upper end of the rod 20. By moving the rod 20, the cleaning elements 12 penetrate into the air openings 8 and remove waste materials from the air openings 8.

Figure 6:
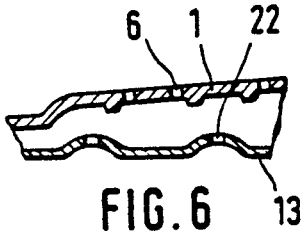
FIG. 6 is an enlarged illustration of the detail X of FIG. 1.

The lid 1 has ventilating devices 6, for example in the form of circular openings, in the illustrated exemplary embodiment. An inside lid 13 is arranged on the inner side of the lid 1, which inside lid 13 has ribs as shown in FIG. 6, which ribs have holes or recesses 22 at their tops. Rain water entering through the openings 6 is thus caught by the inside lid 13 and can be discharged through suitable recesses in the edge area 23 of the lid.

Figure 4:
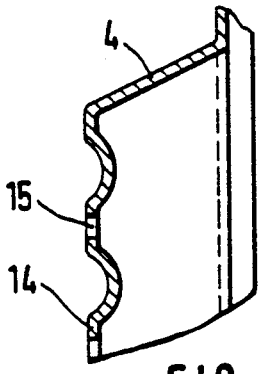
FIG. 4 is an enlarged illustration of the detail Y of FIG. 3.
Figure 2:
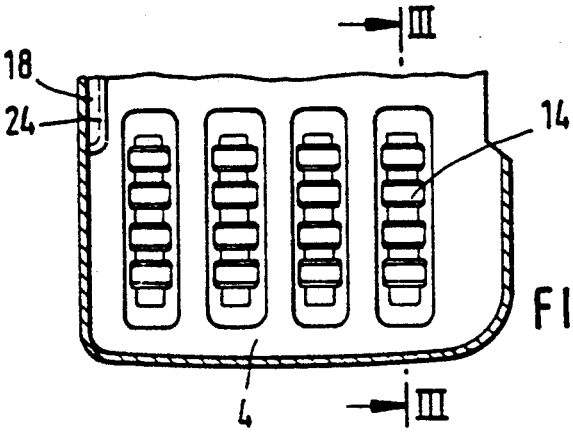
FIG. 2 is a partially cross-sectioned top view of the bottom area of the container.
Figure 3:
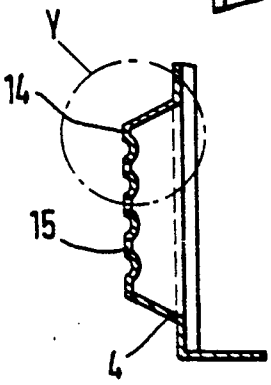
FIG. 3 is a cross-sectional view taken along the line III-III of FIG. 2.

FIGS. 2 to 4 show a detailed view of the insert floor 4. The insert floor is designed riblike with the lower rib areas 14 only partially resting on the bottom 3 of the lower part 2 and thus permit the movement of liquid. Furthermore, the lower rib areas 14 have recesses 15 as shown in FIGS. 3 and 4, through which recesses the entered water can run off into the space 16. To empty the water out of the space 16, the insert floor 4 has a channel-shaped outlet 24 with the shape of a spout. The outlet 24 can be designed such that first the content in the lower part 2 and thereafter the water from the space 16 can be discharged.

Figure 7:
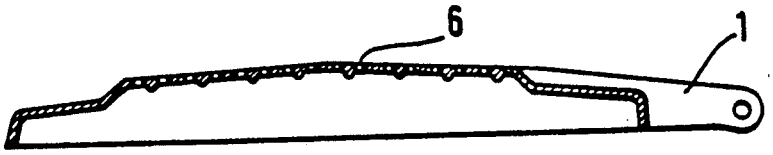
FIGS. 7 and 8 are cross-sectional views of different exemplary embodiments of lids of the collecting container.
Figure 8:
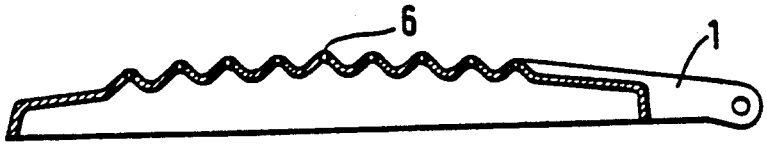

FIGS. 7 and 8 illustrate various designs of the lid 1 with FIG. 7 illustrating a design corresponding substantially with the exemplary embodiment shown in FIG. 1 and preferably requiring an inside lid for discharging rain water and any liquid condensate. The exemplary embodiment illustrated in FIG. 8 has several ribs, in which the ventilating recesses 6 are each arranged at the top of the ribs so that the prospects of rain water, which has accumulated on the surface of the lid 1, running into the container is very low. Instead the water will accumulate in the valleys between the ribs and will run off laterally.

Figure 9:
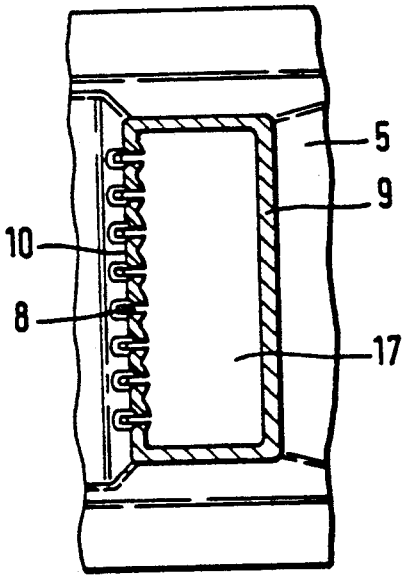
FIG. 9 is a cross-sectional view taken along the line IX—IX of FIG. 11 of the ventilating element of the invention.
Figure 10:
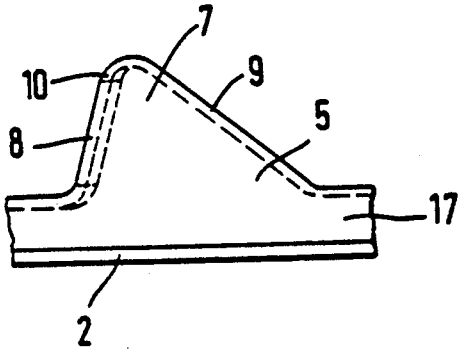
FIG. 10 is a partial side view of the ventilating element.
Figure 11:
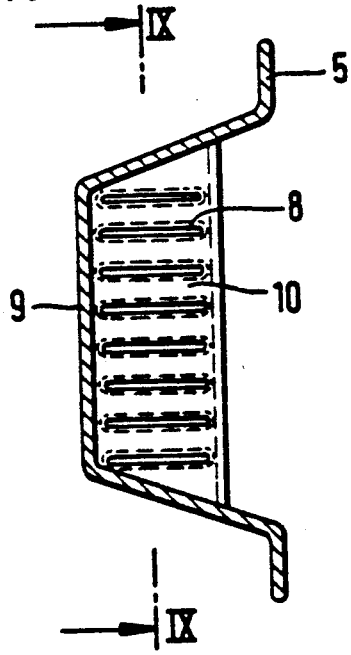
FIG. 11 is a cross-sectional view taken along the line XI—XI of FIG. 12 of the ventilating element.
Figure 12:
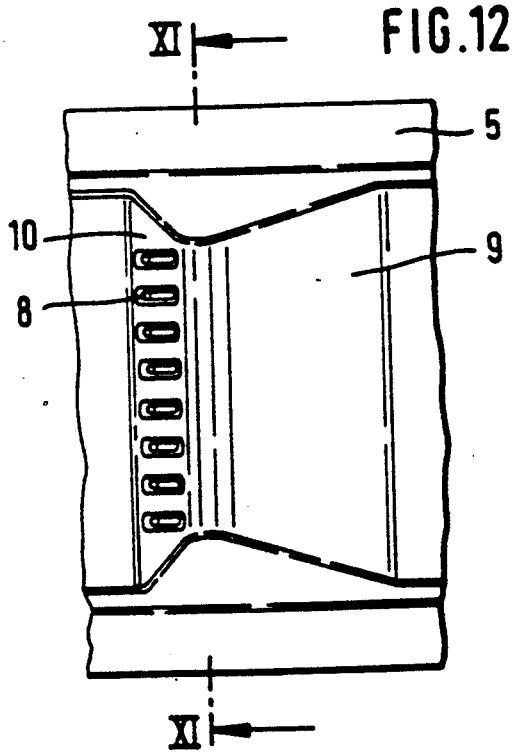
FIG. 12 is a side view of a portion of the ventilating element of the invention.

FIGS. 9 to 12 show detailed views of the ventilating element 5 with FIG. 10 illustrating a side view of the projection 7, from which again the different inclination of the upper side 9 and of the underside 10 can be seen. FIG. 12 is a side view or a frontal view of the ventilating element and clearly shows in detail the arrangement of the first air openings 8. FIG. 9 is a cross-sectional view taken along the line IX—IX of FIG. 11, while FIG. 11 is a cross-sectional view taken along the line XI—XI of FIG. 12. FIG. 1 again clearly shows the size and arrangement of the ventilating openings 8, while FIG. 9 shows that the underside 10 of the projection 7 has grooves to make a penetration of waste materials into the first air openings 8 more difficult. The nose-shaped projection 7 has preferably smooth ribs raised in discharge direction, while the ventilating slots or bores are arranged in the set-back areas. In this manner it is avoided that in particular during filling or emptying of the container the recesses are clogged by the material in the container.

In order to connect the inside space 17 of the ventilating element 5 with the outside, second air openings 11 are arranged on the backwall of the collecting container illustrated in FIG. 1, which air openings 11 can be closed off for example by means of an insect screen.

The invention is not to be limited to the illustrated exemplary embodiments, rather many modification possibilities exist for the man skilled in the art. For example, it is possible to arrange several of the ventilating elements 5 not only on the backwall but also on the sidewall of the container and to laterally incline the respective projections 7 in such a manner that these do not influence the emptying operation.

The embodiments of the invention in which an exclusive property or privilege is claimed are defined as follows:

1. A waste-collecting container comprising an upper lid and a lower part which can be closed off by means of said lid, an insert floor in said lower part spaced from its bottom to define a space, on at least one inside wall of said lower part there is provided a shaftlike ventilating element connected to said space formed by the insert floor, and said inside wall of said lower part, which wall is provided with said ventilation element, is equipped with upper and lower second air openings extending to the outside.

2. The container according to claim 1, wherein said lid has ventilating devices.

3. The container according to claim 1, wherein said ventilating element is provided with noselike projections projecting into the inside of said lower part, with first air openings being arranged on lower sides of said projections.

4. The container according to claim 3, wherein an upper side of said projection is inclined with a relatively small angle with respect to the vertical, while the underside has a relatively large angle of inclination with respect to the vertical.

5. The container according to claim 3, wherein said first air openings are constructed in the form of several elongated slots which are parallel with one another, with the slotlike openings being profiled at their edges.

6. The container according to claim 3, wherein cleaning elements for said first air openings are arranged inside of said ventilating element, said cleaning elements being movable relative to said first ventilating openings.

7. The container according to claim 6, wherein said cleaning elements are supported movably in said lower part, while said ventilating element is mounted stationarily.

8. The container according to claim 1, wherein said lid includes and inside lid and an outside lid, said outside lid and inside lid being provided with ventilating openings therethrough arranged on said lids, said inside lid being arched into a cavity formed on an underside of said outside lid.

9. The container according to claim 1, wherein said insert floor is designed with ribs and has openings therethrough particularly at the lower rib areas.

10. The container according to claim 1, wherein said space formed by said insert floor is connected to an inside space of said ventilating element.

11. The container according to claim 1, wherein said space formed by said insert floor is provided with a liquid discharge opening extending into said lower part.

12. The container according to claim 1, wherein said lid includes means for catching and discharging of water.

13.. The container according to claim 11, wherein the openings in the container extending to the outside are equipped with means for preventing insects from penetrating.

14. The container according to claim 1, wherein said insert floor and said space forms ventilating chambers and has hollow ribs, which project down into said bottom of said lower part and contact the bottom with wavelike bearing surfaces, on the contact surfaces of which bottom in turn openings are arranged.

15. The container according to claim 3, wherein hollow ribs are designed on the noselike projections, which hollow ribs have a slotlike or round shape.

16. The container according to claim 8, wherein said outside lid is fixedly connected to said inside lid, said inside lid being mounted in said cavity in said outside lid, said inside lid being equipped with ribs projecting into the cavity of said outside lid and provided with ventilating openings at the highest point of the ribs, which ribs are arranged offset with respect to the ventilating openings in said outside lid, and wherein the inside lid has a drip edge at the outer edges thereof projecting over the edge of said lower part, and wherein said inside lid is arranged such that convection slots remain between the edge of said lower part and the inner surface of said inside lid.

17. The container according to claim 8, wherein said inside lid is shaped wavelike and ventilating openings are arranged on the tops of the waves.

18. The container according to claim 8, wherein said inside lid has relatively large ventilating openings in comparison to said outside lid.

19. The container according to claim 8, wherein said inside lid is connected to said outside lid such that when said outside lid is closed, ventilating and discharge slots remain between the outside lid walls and between the inside lid and the upper edge of the container.

20. The container ,according to claim 16, wherein an inner surface of said outside lid has ribs which are arranged such that they project down into the spaces between said rib and, forming drip ribs for condensate, spatially define the ventilating openings of said lid.

21. The container according to claim 1, wherein said insert floor is removably fastened.

22. The container according to claim 1, wherein a screen insert is connected onto said insert floor.

23. The container according to claim 22, wherein said screen insert acts very fine-pored absorbingly and filteringly and consists in particular of a decomposable material.

24. The container according to claim 3, wherein the undersurface of the noselike projections is corrugated and slotted transversely with respect to the direction of the nose.

25. The container according to claim 1, wherein said ventilating element is removable.

* * * * *

UNITED STATES PATENT AND TRADEMARK OFFICE

CERTIFICATE OF CORRECTION

PATENT NO. : 5 036 999

DATED : August 6, 1991

INVENTOR(S) : Bartholomaeus BITSCH

It is certified that error appears in the above-identified patent and that said Letters Patent is hereby corrected as shown below:

Column 7, line 4; change "claim 11" to ---claim 1---.

Signed and Sealed this

Thirtieth Day of March, 1993

*Attest:*

STEPHEN G. KUNIN

*Attesting Officer*

*Acting Commissioner of Patents and Trademarks*